US007397191B2

(12) United States Patent
Kikuchi et al.

(10) Patent No.: US 7,397,191 B2
(45) Date of Patent: Jul. 8, 2008

(54) HIGH PRESSURE DISCHARGE LAMP HAVING A CONICAL PART AND A CYLINDRICAL BODY PART

(75) Inventors: Yasuro Kikuchi, Himeji (JP); Norihiro Inaoka, Kakogawa (JP); Kyosuke Fujina, Shiso-gun (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 506 days.

(21) Appl. No.: 10/979,320

(22) Filed: Nov. 3, 2004

(65) Prior Publication Data

US 2005/0099121 A1 May 12, 2005

(30) Foreign Application Priority Data

Nov. 7, 2003 (JP) ..... 2003-378484

(51) Int. Cl.
*H01J 17/04* (2006.01)
*H01J 61/04* (2006.01)

(52) U.S. Cl. ..... 313/632; 313/326; 313/631; 313/633

(58) Field of Classification Search ..... 313/326, 313/631–633
See application file for complete search history.

(56) References Cited

U.S. PATENT DOCUMENTS

| | | | | |
|---|---|---|---|---|
| 3,248,591 | A * | 4/1966 | Arndt | 313/40 |
| 6,215,247 | B1 * | 4/2001 | Kurano et al. | 313/631 |
| 6,227,926 | B1 | 5/2001 | Kurano et al. | |
| 2002/0074943 | A1 * | 6/2002 | Mehr et al. | 313/631 |

FOREIGN PATENT DOCUMENTS

| | | |
|---|---|---|
| JP | 2000-021349 | 1/2000 |

* cited by examiner

*Primary Examiner*—Toan Ton
*Assistant Examiner*—Bumsuk Won
(74) *Attorney, Agent, or Firm*—David S. Safran

(57) ABSTRACT

A high pressure discharge lamp in which the cathode has a cylindrical body part and a conical part which is doped with thorium dioxide ($ThO_2$), and with a diameter which decreases in a direction from the body part toward the tip area of the conical part by at least one light receiving surface area being formed between the body part and the tip area of the cone in a base part of the conical part. The light receiving area lies at an angle with respect to the center axis of the conical part and the body part, said angle which is measured from the side of the body part being greater than the angle of inclination which is formed between the outer periphery of the conical part in the tip area of the cone and the center axis.

8 Claims, 3 Drawing Sheets

HIGH PRESSURE DISCHARGE LAMP HAVING A CONICAL PART AND A CYLINDRICAL BODY PART

BACKGROUND OF THE INVENTION

1. Field of the Invention

The invention relates to a high pressure discharge lamp, such as a xenon lamp, a high pressure mercury lamp, or the like. The xenon lamp is used, for example, in a projection apparatus or the like using DLP (digital light processing) technology as a light source. The high pressure mercury lamp is used, for example, as a light source in a semiconductor exposure device of a liquid crystal exposure device, a device for exposure of a printed board or the like.

2. Description of Related Art

Conventionally, a lamp with the arrangement which is shown by way of example in FIG. 3 is known as a high pressure discharge lamp. This high pressure discharge lamp 10 is made of a silica glass bulb which has a light emitting part 11 and hermetically sealing parts 12. Furthermore, the high pressure discharge lamp 10 consists of a cathode 13 and an anode 14 which are located within the light emitting part 11 opposite one another.

The tungsten upholding part 131 of the electrode supports the cathode 13 and the tungsten upholding part 141 of the electrode supports the anode 14. The upholding parts 131, 141 of the electrodes are each inserted into and held in a holding cylinder 16 which is fixed within the hermetically sealing part 12, which is cylindrical, made of silica glass and within which there is a through opening which runs in the axial direction. The upholding parts 131, 141 of the electrode are sealed by means of a graded glass 15 in the hermetically sealing part 12, extend from the outer end of the bulb to the outside, projecting over it, and also act as outer lead pins which feed power to the cathode 13 and the anode 14.

In a high pressure discharge lamp 10 with the above described arrangement the cathode 13, as shown in FIG. 4, has a cylindrical body part 132 and a conical part 134 which has the shape of a truncated cone and which is located on one end of this body part 132 integrally with it. The diameter along the axis L of this body part 132 forward (to the left in the drawing) gradually decreases and on its tip a round flat tip surface 133 is formed. This conical part 134 is made of thoriated tungsten in which tungsten, as a metal with a high melting point, has been doped with an electron emissive material of thorium dioxide ($ThO_2$). The anode 14 is made of pure tungsten.

In this cathode 13, in its conical part 134, thorium which is produced by reduction of the doped-in thorium dioxide by the tungsten acts as the emitter; this leads to stable emission of electrons. As a result the formation of a discharge arc is simplified.

However, for the reduction of thorium dioxide by tungsten, a very high temperature of at least 2500° C. is necessary. In a normal state of use, in the area outside the tip-side area 136 which is adjacent to the discharge arc in the conical part 134—i.e., in the area 135 on the base side—it is difficult to obtain such a high temperature state. As a result, in this area 135, on the base side, the reduction reaction of thorium dioxide by tungsten does not progress. Therefore, thorium which acts as an emitter cannot be efficiently produced.

On the surface of the conical part 134, the ratio of the reduction to thorium to the total amount of doped thorium dioxide—i.e., the reduction ratio of the thorium dioxide—is low, as was described above. Therefore, thorium dioxide cannot be used with high efficiency. As a result of the fact that the absolute amount of thorium which in fact contributes to the formation of the discharge arc decreases, therefore, there is the disadvantage that in the high pressure discharge lamp 10 a long enough operating service life cannot be obtained.

In order to eliminate the above described disadvantage, it has been proposed that, in the conical part 134, the surface of the area 135 on the base side be subjected to carbonization and that, in this area 135 on the base side, surface layers of tungsten carbide ($W_2C$), be formed (see, for example, Japanese patent disclosure document 2000-21349).

This arrangement makes it possible to reduce the thorium dioxide in a relatively low temperature range of at least roughly 1800° C.; in a normal state of use, this also leads to accomplishment of a temperature which is necessary for reduction of thorium dioxide in a wide range on the surface of the conical part 134 of the cathode 13. In this way, the degree of reduction of the thorium dioxide is increased and a large amount of thorium does in fact contribute to formation of the discharge arc. Therefore, it becomes possible to prolong the service life of the high pressure discharge lamp 10.

However, in the normal state of use, in the conical area 134, on the surface of which the tungsten carbide layers have formed, in the area 135 on the base side, there is an area in which a high enough temperature is not reached. Therefore, a high enough degree of reduction of the thorium dioxide cannot be implemented. Thus, it was found that there is the disadvantage that in this high pressure discharge lamp 10 the expected service life cannot be achieved.

SUMMARY OF THE INVENTION

The invention was devised to eliminate the aforementioned disadvantage in the prior art. As such, a primary object of the invention is to devise a high pressure discharge lamp with a long operating service life in which in the normal state of use a high degree of reduction of the thorium dioxide in the surface area of the conical part of the cathode is achieved.

This object is achieved in accordance with the invention by a high pressure discharge lamp of the initially mentioned type in which, between the body part and the tip area of the cone, at least one light receiving surface area is formed in the base part of the cone which lies in at an angle with respect to the center axis of the conical part which passes through the tip area of the cone and the body part, said angle, which is measured from the side of the body part, being greater than the angle of inclination which is formed between the center axis and the outer periphery of the conical part in the tip area of the cone.

In particular, in a high pressure discharge lamp in which in the bulb there are an opposed anode and cathode, the object is achieved in that the cathode has a cylindrical body part and a conical part which has a shape which corresponds to the peripheral surface of a virtual cone with a diameter which decreases towards the front proceeding from one end of this body part and which is doped with thorium dioxide ($ThO_2$). Furthermore, the conical part has a base part of the cone which borders the above described body part and in which the surface layer is formed from tungsten carbide, and a pointed area of the cone which extends forward from this base part of the cone, and in the base part of the cone light receiving surface areas are formed which, with respect to the axis of the above described body part, rise with a larger angle than the angle of inclination $\theta$ with respect to the virtual cone and which are opposite the discharge arc which is formed between the cathode and the anode.

The object is furthermore advantageously achieved by the invention in that, in the above described arrangement, the base part of the cone has a step-like peripheral surface, and that the step surfaces of these steps form light receiving surface areas which extend perpendicularly to the axis of the above described body part.

Advantage

By the high pressure discharge lamp of the invention, by the measure that the base part of the cone in the conical area of the cathode rises with an angle $\theta_2$ greater than the angle of inclination $\theta_1$ with respect to this base part and is opposite the discharge arc and that the base part of the cone has light receiving surface areas which receive the radiant light from this discharge lamp arc, these light receiving surface areas absorb the radiant heat from the discharge arc. As a result, the temperature of this base part of the cone becomes high; this leads to reliable implementation of a high degree of reduction of the thorium dioxide in the entire cone part. Therefore, it becomes possible to use the expected amount of thorium for stable formation of the discharge arc. As a result, in a high pressure discharge lamp the expected long operating service life can be reliably obtained.

The invention is further described below using several embodiments which are shown in the drawings.

DETAILED DESCRIPTION OF THE INVENTION

Figure 1:
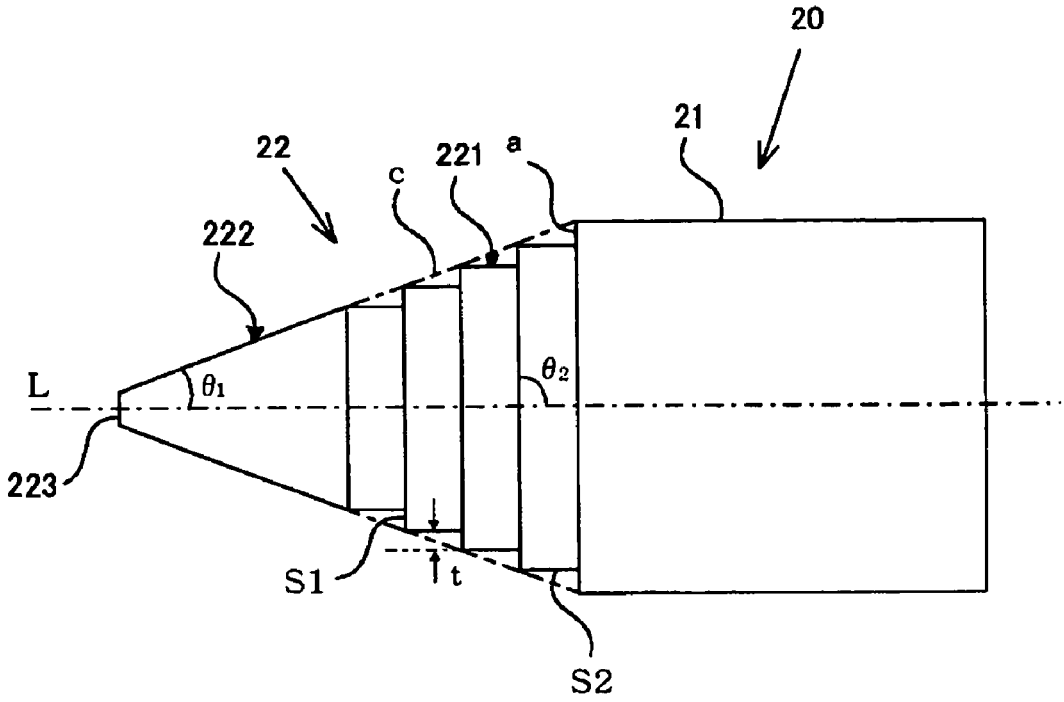
FIG. 1 is a schematic side view of one example of the arrangement of the cathode of a high pressure discharge lamp in accordance with the invention.

FIG. 1 shows a schematic side view of one example of the arrangement of the cathode of a high pressure discharge lamp of the invention which has a cathode 20 with the configuration shown in FIG. 1. Such a cathode may be used in a lamp that has the same arrangement as the high pressure discharge lamp 10 which is shown, for example, in FIG. 3. Here, the high pressure discharge lamp of the invention, instead of the arrangement shown in FIG. 3, can have a hermetically sealing arrangement using a metal foil (not shown in the drawings).

In FIG. 1, for the cathode 20, a cylindrical body part 21 is formed integrally with a conical part 22 with a diameter which decreases gradually proceeding from one end of this body part 21 forward (to the left in the drawing) in the direction of its center axis L and which has a shape which corresponds to the peripheral surface of a virtual cone C with an angle of inclination $\theta_1$. This means that the outer edges of the steps which are formed by the gradual change of the radius of the conical part, which edges point toward the tip of the cone, lie on the periphery of the virtual cone with an angle of inclination $\theta_1$.

The conical part 22 has a base part 221 of the cone and a tip area 222 of the cone. The base part 221 of the cone is formed by step surfaces S1 and step-like peripheral surfaces S2. The respective step surface S1 rises with an angle $\theta_2$ with respect to the axis L of 90° and is made in the shape of an annular strip or band which is aligned in the direction to the tip of the cone. The respective step-like peripheral surface S2 runs proceeding from one edge of this step surface S1 forward parallel to the axis L and forms a cylindrical peripheral surface. The base part 221 of the cone is made step-like such that annular corner edge areas which are formed by these step surfaces S1 and the step-like peripheral surfaces S2 extend on the peripheral surface of the above described virtual cone C along the peripheral direction. The base part 221 of the cone, for example, proceeding from one end of the body part 21 forward has a stepped peripheral surface which is provided in alternation with four step surfaces S1 and four step-like peripheral surfaces S2 with diameters which decrease gradually. The tip area 222 of the cone has a peripheral surface which extends farther forward from this base part 221 of the cone and which corresponds to the peripheral surface of the virtual cone C.

Furthermore, the respective step surface S1 forms a light receiving surface area a which is opposite the discharge arc. Here, this step surface S1 (the light receiving surface area a) has a width t in its radial direction of 0.1 mm to 1 mm.

In the above described arrangement, the expression "angle of inclination $\theta_1$" with respect to the virtual cone C is defined as an angle of inclination in which the above described axis L of the peripheral surface of this virtual cone C is called the reference, i.e., the angle which is formed between the peripheral surface of the tip area 222 of the cone and the axis L, as shown in FIG. 1.

The expression "rising angle $\theta_2$" of the light receiving surface area is defined as the angle of a surface which forms the light receiving surface area with respect to the axis L, therefore, the angle which is formed between the surface which accommodates the step surface S1 which forms the light receiving surface area a, and the axis L, as shown in FIG. 1.

The body part 21 and the conical part 22 are formed by a metal with a high melting point which has been doped with an electron emissive material. Specifically, they are formed by thoriated tungsten in which a metal with a high melting point (tungsten) is doped with an electron emissive material (thorium dioxide).

Here, it is advantageous that the ratio of the content of thorium dioxide in the thoriated tungsten comprising the cathode is 1% by mass to 4% by mass.

In the base part 221 of the cone, a surface layer is formed which is made of tungsten carbide which has been formed by carbonization. The tungsten carbide layer of the surface layer of this base part 221 of the cone is used to reduce the thorium dioxide in a relatively low temperature range of at least about 1800° C.

The overall shape of the above described cathode 20 is determined by various conditions, such as the shape of the reflector which is installed for use, for example, as a light source device, by the service life which is required for the high pressure discharge lamp, by the value of the input current, and the like. Specifically, the angle of inclination $\theta_1$ is, for example, 30° to 60°, the diameter of the body part 21 is, for example, 4 mm to 12 mm, and the diameter of the tip surface 223 is, for example, 0.2 to 0.6 mm.

The discharge space which is delineated by the bulb is filled with a rare gas such as for example argon, xenon and the like, for example in the range from 0.01 MPa to 1 MPa, or together with these rare gases, mercury, for example in the range from 1 mg/cm$^3$ to 100 mg/cm$^3$. In the case of adding mercury to the discharge space a high pressure discharge lamp is used which does not have the arrangement shown in FIG. 3, but a hermetically sealed arrangement using a metal foil.

In the high pressure discharge lamp of the invention, the base part of the cone at the cathode has light receiving surface areas which rise with a greater angle than the angle of inclination of the virtual cone with respect to this cathode and which are opposite the discharge arc. In this way, the radiant light from the discharge arc is received by the light receiving surface areas. As a result, the temperature of this base part of the cone is higher than in the case without these light receiving surface areas. Consequently, for reduction of the thorium dioxide by tungsten carbide, a relatively high temperature is accomplished with certainty. Therefore, it becomes possible to use thorium which is present on the surface of the conical part as thorium dioxide, with a high utilization factor for stable formation of the discharge arc. As a result, the expectedly long operating service life is accomplished with certainty according to the amount of doped thorium dioxide.

In the above described arrangement, the step surface S1 which forms the light receiving surface area has a width t of at least 0.1 mm. By this measure, a relatively large area is ensured in this light receiving surface area. Reception of a sufficient amount of radiant heat is enabled. As a result, a high temperature which is required for reduction of the thorium dioxide by tungsten carbide is adequately implemented moreover with certainty.

The execution of the invention was described in specific terms above. However the invention is not limited to the above described execution, but various changes can be added.

Figure 2:
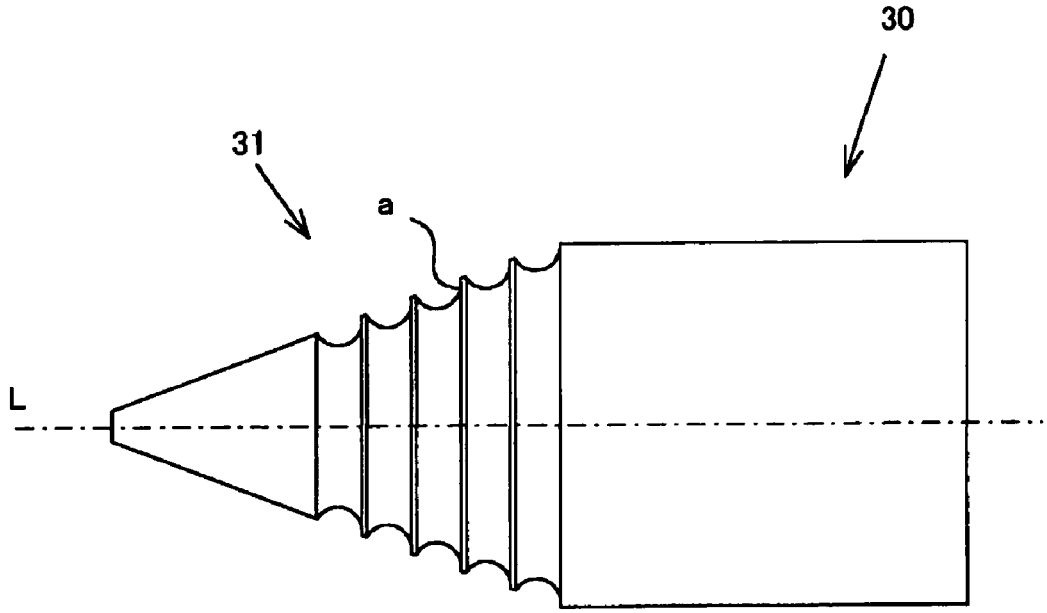
FIG. 2 shows a schematic side view of another example of the arrangement of the cathode of a high pressure discharge lamp of the invention.

The high pressure discharge lamp in accordance with the invention can, for example, have a cathode 30 with the arrangement shown in FIG. 2. This cathode 30 has a base part 31 of the cone with ring-like grooves on its peripheral surface; they extend in the peripheral direction and in them the cross sections which are perpendicular to the direction of extension are arc-shaped and are formed in such a manner that they are arranged parallel to the direction of the axis L. Light receiving surface areas are formed by the base part 31 of the cone by the surface areas a which are opposite the discharge arc (face the discharge arc) and which each constitute a rising area of the inside wall of this groove.

Furthermore, in the above described arrangement, the surface of the base part of the cone for the cathode can be subjected to frost treatment. The base part of the cone with this arrangement in which frost treatment has been carried out has a large area. It is therefore possible to dope a large amount of thorium dioxide. Furthermore, the temperature which is necessary for reduction of the thorium dioxide is implemented with certainty. In this way, a high utilization factor is achieved for this large amount of thorium. Therefore, a large amount of thorium can be used to form the discharge arc. As a result, it is possible to obtain a long service life of a high pressure discharge lamp.

Embodiment

COMPARISON EXAMPLE

Figure 3:
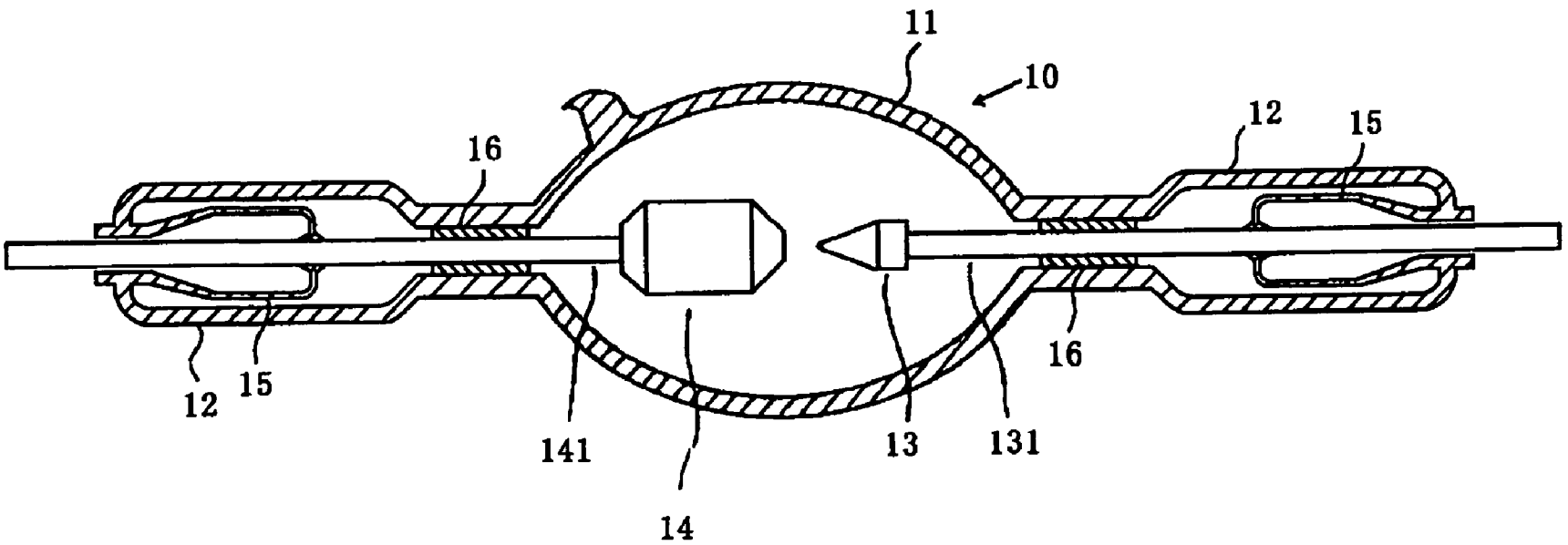
FIG. 3 is a schematic cross-sectional view which shows one example of the arrangement of a high pressure discharge lamp using a cross section along the tube axis.
Figure 4:
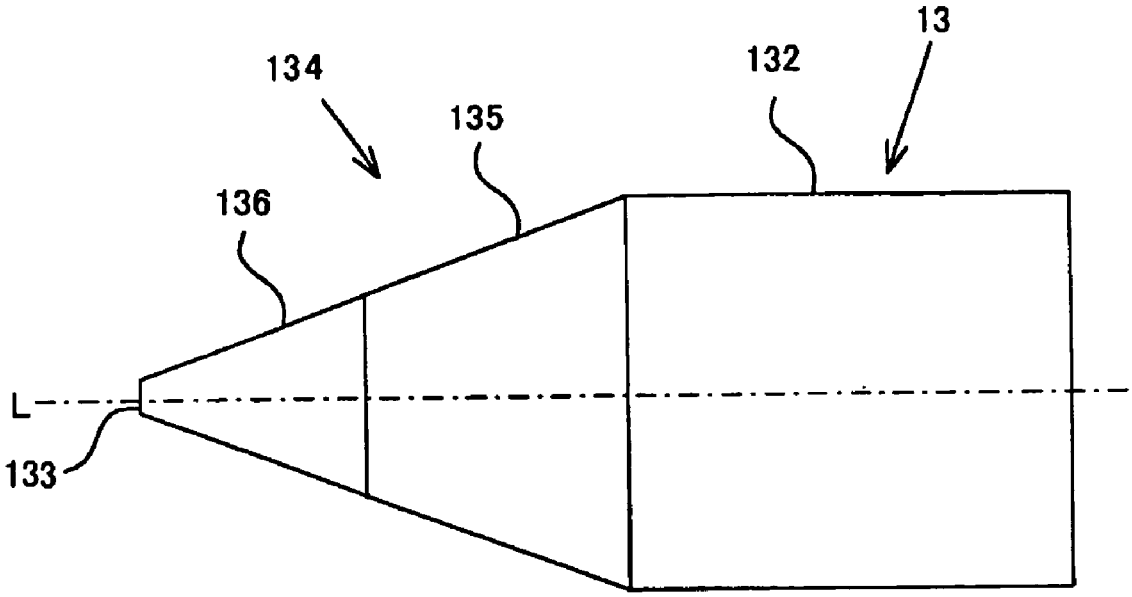
FIG. 4 is a schematic side view of one example of the arrangement of the cathode of a conventional high pressure discharge lamp.

A xenon lamp with the arrangement shown in FIG. 3 is produced, with an output power of 2 kW and an operating pressure of 8 MPa, in which the interior of a silica glass bulb is filled with xenon gas. This xenon lamp has a cathode with the arrangement shown in FIG. 4. The material thereof is tungsten which has been doped with a ratio of 2% by weight thorium dioxide. The diameter of the tip area of the cathode is 0.4 mm, the angle of inclination $\theta_1$ with respect to the tip area of the cone is 40° and the diameter of the body part is 6 mm. In the xenon lamp obtained the operating service life was measured. It was 1150 hours.

Embodiment

A xenon lamp was produced in the same way as the above described comparison example, except for the fact that a cathode with the arrangement shown in FIG. 1 was used. In this xenon lamp, the width t in the radial direction of the step surface S1 in the step region of the base part 221 of the cone is 0.2 mm and the width of the step peripheral area which extends in the direction of the axis L is 1.0 mm. The volume is essentially equal to that of the cathode in the above described comparison example. As a result of the measurement of the operating service life in the xenon lamp which was obtained, an operating service life of 1350 hours was obtained.

Action of the Invention

The above described result shows that a high pressure discharge lamp in accordance with the invention has a far longer service life than the conventional lamp.

What we claim is:

1. High pressure discharge lamp, comprising:

a bulb;

an opposed anode and a cathode in said bulb, the cathode having a cylindrical body part and a conical part which is doped with thorium dioxide ($ThO_2$), and the conical part having a diameter which decreases proceeding from the body part in a direction toward the tip area of the conical part, wherein, between the body part and the tip area of the conical part, at least one light receiving surface area is formed at a base part of the conical part, the at least one light receiving surface area extending in a plane which intersects a center axis of the conical part which passes through the tip area of the conical part and the body part, wherein an angle, which is formed between the plane and the center axis and which is measured from a side of the body part, is greater than an angle of inclination which is formed between the outer periphery of the conical part in the tip area of the conical part and the center axis; and wherein said at least one light receiving surface area comprise a plurality of step-shaped areas arranged in succession in the manner of stairs on the conical part, a step surface of a step of each of the step-shaped areas facing in a direction toward the tip area of the conical part so as to absorb radiant heat from a discharge arc formed between the cathode and anode.

2. High pressure discharge lamp as claimed in claim 1, wherein the light receiving surface areas are ring-shaped.

3. High pressure discharge lamp as claimed in claim 1, wherein the at least one light receiving surface areas are arranged essentially perpendicularly relative to the center axis of the conical part.

4. High pressure discharge lamp as claimed in claim 1, wherein the light receiving surface areas have an outer periphery which increases from area to area in a direction toward the body part.

5. High pressure discharge lamp as claimed in claim 1, wherein adjacent light receiving surface areas are connected to one another by an outer peripheral surface which runs in a direction from the body part toward the tip area of the conical part.

6. High pressure discharge lamp as claimed in claim 5, wherein the outer peripheral surface runs essentially parallel to the center axis of the conical part.

7. High pressure discharge lamp as claimed in claim 1, wherein the surface of the base part of the conical part is provided at least in parts with a surface coating of tungsten carbide.

8. High pressure discharge lamp as claimed in claim 7, wherein the cathode is made of tungsten as a base material thereof.

* * * * *